US006675539B2

(12) United States Patent
Shreiner

(10) Patent No.: US 6,675,539 B2
(45) Date of Patent: Jan. 13, 2004

(54) ROOF SEISMIC MOTION-ABSORBING GAP COVER

(75) Inventor: Thomas A. Shreiner, Picture Rocks, PA (US)

(73) Assignee: Construction Specialties, Inc., Lebanon, NJ (US)

( * ) Notice: Subject to any disclaimer, the term of this patent is extended or adjusted under 35 U.S.C. 154(b) by 146 days.

(21) Appl. No.: 09/883,517

(22) Filed: Jun. 18, 2001

(65) Prior Publication Data

US 2003/0205004 A1 Nov. 6, 2003

(51) Int. Cl.[7] ..... E04B 1/36; E04H 9/02

(52) U.S. Cl. ..... 52/66; 52/167.3; 52/167.4; 52/393; 52/573.1; 52/396.02; 52/396.03

(58) Field of Search ..... 52/66, 167.4, 167.3, 52/393, 573.1, 396.02, 396.03

(56) References Cited

U.S. PATENT DOCUMENTS 4,848,044 A * 7/1989 LaRoche et al. ..... 404/68
4,882,890 A * 11/1989 Rizza ..... 52/395
4,977,719 A * 12/1990 LaRoche et al. ..... 52/396.01
5,078,529 A * 1/1992 Moulton ..... 403/24
5,365,713 A * 11/1994 Nicholas et al. ..... 52/396.03
5,537,790 A * 7/1996 Jackson ..... 14/73.1
5,644,879 A * 7/1997 Shreiner et al. ..... 52/393
5,829,216 A * 11/1998 Newcomb et al. ..... 52/167.1
5,832,678 A * 11/1998 Newcomb et al. ..... 14/73.1

* cited by examiner

*Primary Examiner*—Carl D. Friedman
*Assistant Examiner*—Christy M. Green
(74) *Attorney, Agent, or Firm*—Baker Botts L.L.P.

(57) ABSTRACT

A seismic roof motion-absorbing gap cover assembly includes an elongated y-axis slideway affixed to a building unit B on one side of the gap and extending parallel to the gap and a y-axis slider slidably received on the y-axis slideway. Roof support members are secured to the y-axis slider in spaced apart relation against horizontal movements. A roof having one end affixed to a building unit A on the other side of the gap spans the gap and is supported on the roof support members by elongated spaced-apart x-axis slide members for movement along an x-axis perpendicular to the gap. Each x-axis slide member has a length such that it is supported by the roof support member throughout a range of displacements in the x-axis direction of the building units between maximum and minimum design displacements in an earthquake from a neutral position.

23 Claims, 5 Drawing Sheets

ROOF SEISMIC MOTION-ABSORBING GAP COVER

BACKGROUND OF THE INVENTION

Seismic expansion joint covers for buildings in geographic regions that are prone to earthquakes are of special designs that allow for movements of the building units on either side of the expansion gap that are very much greater than the movements that occur as a result of thermal expansion and contraction. In that regard, buildings currently being built in earthquake-prone regions are usually supported on isolators that attenuate the intensities of shocks imparted to the building structure but increase the durations and magnitudes of the swaying motions of the structure as the structure displaces and deforms when forces due to the earthquake are imposed on its foundation supports. When a building is composed of two or more adjacent independent structural units, each structural unit is subject to movements in an earthquake that are different in direction, frequency and magnitude. That is the case, indeed, regardless of whether the units are mounted on isolators or not.

Adjacent structural units of a building are, in particular, subject to large relative movements having components horizontally toward and away from each other (perpendicular to the center plane of the gap)—x-axis movements—and components horizontally parallel to the center plane of the gap—y-axis movements. Because the connections between structural units at expansion joints—which might better be termed "motion-absorbing gaps" and will be so referred to hereinafter—occur at the perimeters of the structural units, the movements include small but meaningful relative displacements vertically and angularly between portions on opposite sides of gaps due to the rocking of the floors at the perimeter of the structural unit about a fulcrum in the region of the bottom center of the structural unit.

U.S. Pat. No. 5,644,879 (Shreiner et al., Jul. 8, 1997), which is owned by the assignee of the present invention and is hereby incorporated herein by reference for all purposes, describes and shows a seismic motion-absorbing gap cover assembly that is adapted to span a gap between the floors of building sections on opposite sides of a motion-absorbing gap and that permits relative movements of the floors substantially horizontally toward and away from each other along an axis perpendicular to the gap ("x-axis direction") and substantially horizontally relative to each other along an axis parallel to the gap ("y-axis direction"). The assembly includes a rectangular structural floor bridge panel that spans the gap in all relative positions of the floors. One end of the bridge panel is attached to the floor on one side of the gap ("floor A") for movement in the y-axis direction and against movement in the x-axis direction relative to floor A. The other end of the bridge panel is supported on the floor of the other building section ("floor B") for movement in the x-axis direction and against movement in the y-axis direction relative to floor B.

Although the motion-absorbing gap covers disclosed in the aforementioned patent and various other previously known motion-absorbing gap covers meet the requirements imposed on them reasonably well, there is a need for a roof motion-absorbing gap cover that is relatively simple in construction and function, light in weight so that forces produced by inertia during by movements in an earthquake are kept relatively low, inexpensive to produce and install, capable of accommodating not only x-axis and y-axis movements but relative displacements vertically and angularly between portions on opposite sides of gaps due to the rocking of the building units, and versatile as far as utility in various environments is concerned.

SUMMARY OF THE INVENTION

The foregoing needs and objectives are met, in accordance with the present invention, by a seismic roof motion-absorbing gap cover assembly that includes an elongated y-axis slideway affixed to a building unit B on one side of a motion-absorbing gap and extending along a y-axis longitudinally parallel to a center plane of the motion-absorbing gap and a y-axis slider received on the y-axis slideway for sliding movement. A plurality of roof support members are secured to the y-axis slider in spaced apart relation against horizontal movements relative to the y-axis slider. A roof having one end affixed to a building unit A on the other side of the motion-absorbing gap spans the motion-absorbing gap and is supported on the roof support members by a plurality of elongated spaced-apart x-axis slide members for movement relative to the roof support members along an x-axis perpendicular to the center plane of the motion-absorbing gap. Each x-axis slide member has a length such that it is supported by the roof support member throughout a range of displacements in the x-axis direction of the building units between maximum and minimum design displacements in an earthquake from a neutral position.

In a seismic roof motion-absorbing gap cover assembly according to the present invention as described generally above, the roof is secured to the building unit A on one side of the motion-absorbing gap. Thus, the roof can be well sealed to building unit A against water intrusion. Most motions of building unit B relative to building unit A in an earthquake are afforded by supporting the B-end of the roof on the y-axis slideway/slider and the plurality of roof support members carried by the y-axis slider and the x-axis slide member associated with each roof support member. In particular, motions of building unit B relative to building unit in the y-axis direction are accommodated by sliding of the y-axis slide axially relative to the y-axis slideway that is affixed to building unit B. Motions of building unit B relative to building unit A in the x-axis direction are afforded by sliding of the x-axis slide members relative to the roof support members. Both x-axis and y-axis relative motions of units A and B may, of course, take place simultaneously—as mentioned above, the magnitudes, directions and frequencies of the motions of the building units in an earthquake usually differ, so x-axis and y-axis motions are virtually always superimposed.

In preferred embodiments, each x-axis slide member is of uniform cross-section along its length and includes a socket portion receiving the roof support member in captured relation and a cover portion along the top and sides of the socket portion. The cover portion shields the socket portion from intrusion of most water and dust, which improves the reliability and maintenance-free life of the assembly.

Each roof support member may have arcuate surfaces that permit the x-axis slide member that it supports to rotate about the x-axis and about a center y-axis of the roof support member perpendicular to a plane parallel to the x-axis and y-axis. Rotation about the x-axis accommodates tilting of the units A and B relative to each other, such tilting accompanying relative displacement in the y-axis direction such that floor and roof planes of the units are slightly out of parallel. Rotation about the y-axis allows for relative motions of the units A and B horizontally that results in skewing of a vertical wall of one unit relative to a vertical wall of the other unit so that they become slightly non-parallel. The above-described arcuate surfaces are conveniently obtained from a manufacturing point of view by providing each roof support member with a substantially spherical head portion.

Each roof support member is, preferably, mounted on the y-axis slider for upward displacement from and for tilting in all directions relative to a supporting surface of the y-axis slider. Upward displacement and tilting of each roof support member allows for vertical movements of the B end of the roof relative to the A end that accompany the relative motions of units A and B described in the immediately preceding paragraph hereof. In particular, one side of the B-end of the roof will lift up relative to the other side, and arranging the roof support members to lift up allows that to occur. It is desirable to resiliently bias each roof support member against the upward displacement and tilting so that it will reseat after an earthquake ceases. It is also desirable that the resilient downward bias of the roof support members collectively provide a total downward force on the B-end of the roof to keep it from being lifted by forces due to wind.

It is preferred that the features described in the two immediately preceding paragraphs be used together to afford motions of the B end of the roof relative to the A end that result when the wall and/or floor planes of the portions of building units A and B adjacent the motion-absorbing gap become skewed relative to each other in an earthquake.

In a suitable design, the y-axis slideway includes a base member of uniform cross section along its length having an upstanding leg portion, and a continuous bearing member of a durable, rigid, low-friction polymeric material received on the base member. The y-axis slider may have a supporting base portion on which the roof support members are mounted and a socket portion depending from the base portion and receiving the bearing member in captured relation. The bearing member and the socket portion of the y-axis slider should be arcuate in cross section so that the y-axis slider can rotate relative to the bearing member about the longitudinal center axis of the bearing member. In that regard, x-axis motions of building units A and B in an earthquake produce small vertical displacements of portions of floors and roofs adjacent the motion-absorbing gap, which in turn causes the edge of the roof of one building unit to be higher than the edge of the roof of the other building unit. Tilting of the roof gap cover about the axis of the y-axis slideway accommodates the small vertical displacements of the edges of the roofs of the building units adjacent to motion-absorbing gap.

1. In preferred embodiments, the roof includes a skeletal framework (which includes the x-axis slide members) and a weather cover supported by the framework. The weather cover has, of course, a width in the x-axis direction greater than the width in the x-axis direction of the motion-absorbing gap so that the weather cover overlies the motion-absorbing gap but less that the width in the x-axis direction of the framework. It is desirable to leave part of the frame without a weather cover in order to minimize wind loads on the part of the installation that extends over the roof of building unit B.

In order to accommodate vertical movements of building unit B relative to building unit A, the roof should be affixed to building unit A for tilting about a tilt axis parallel to the center plane of the motion-absorbing gap.

For a better understanding of the invention, reference may be made to the following description of an exemplary embodiment, taken in conjunction with the accompanying drawings.

DESCRIPTION OF THE EMBODIMENTS

Figure 2:
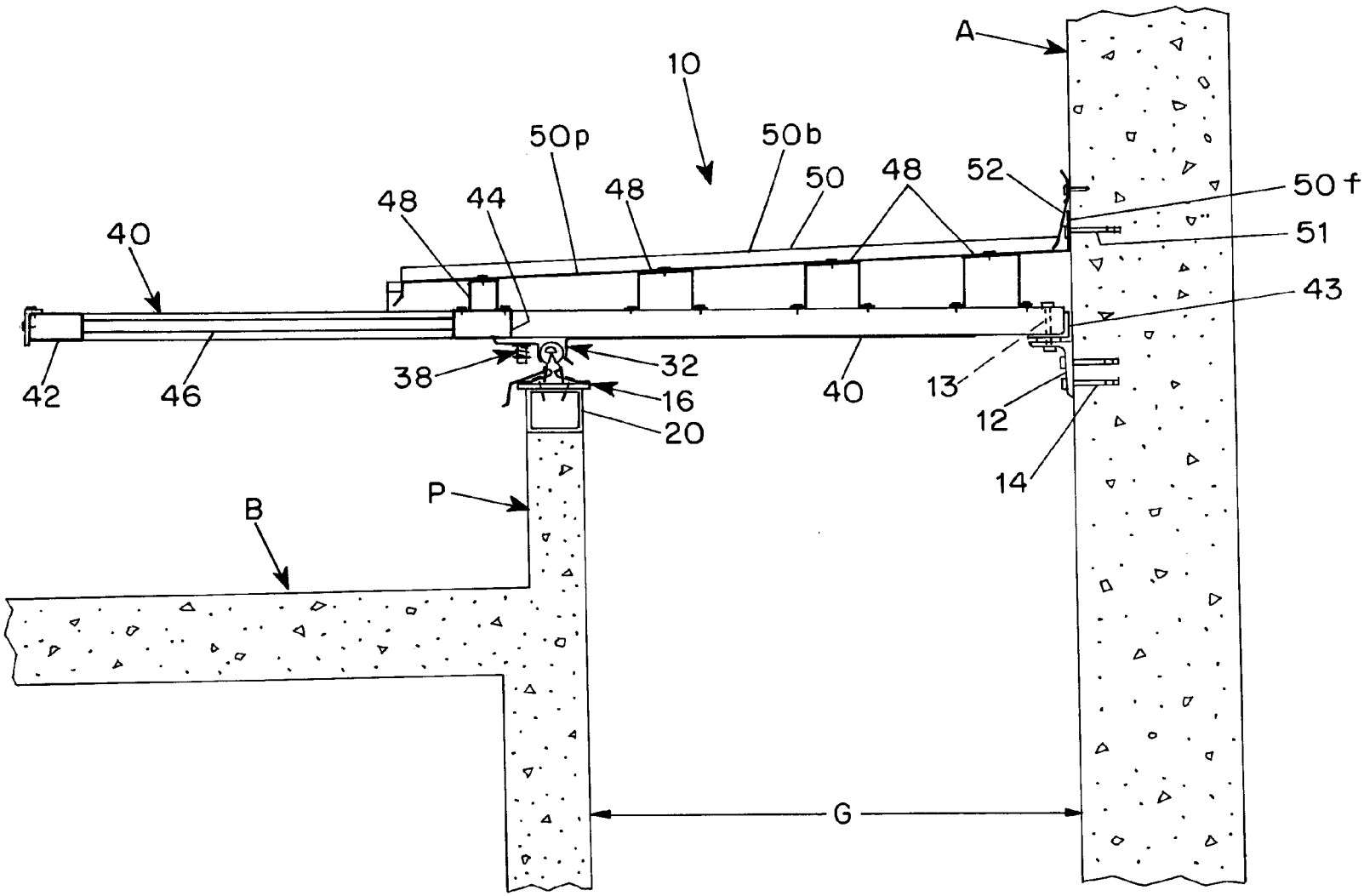
FIG. 2 is a side elevational view of the embodiment.
Figure 3:
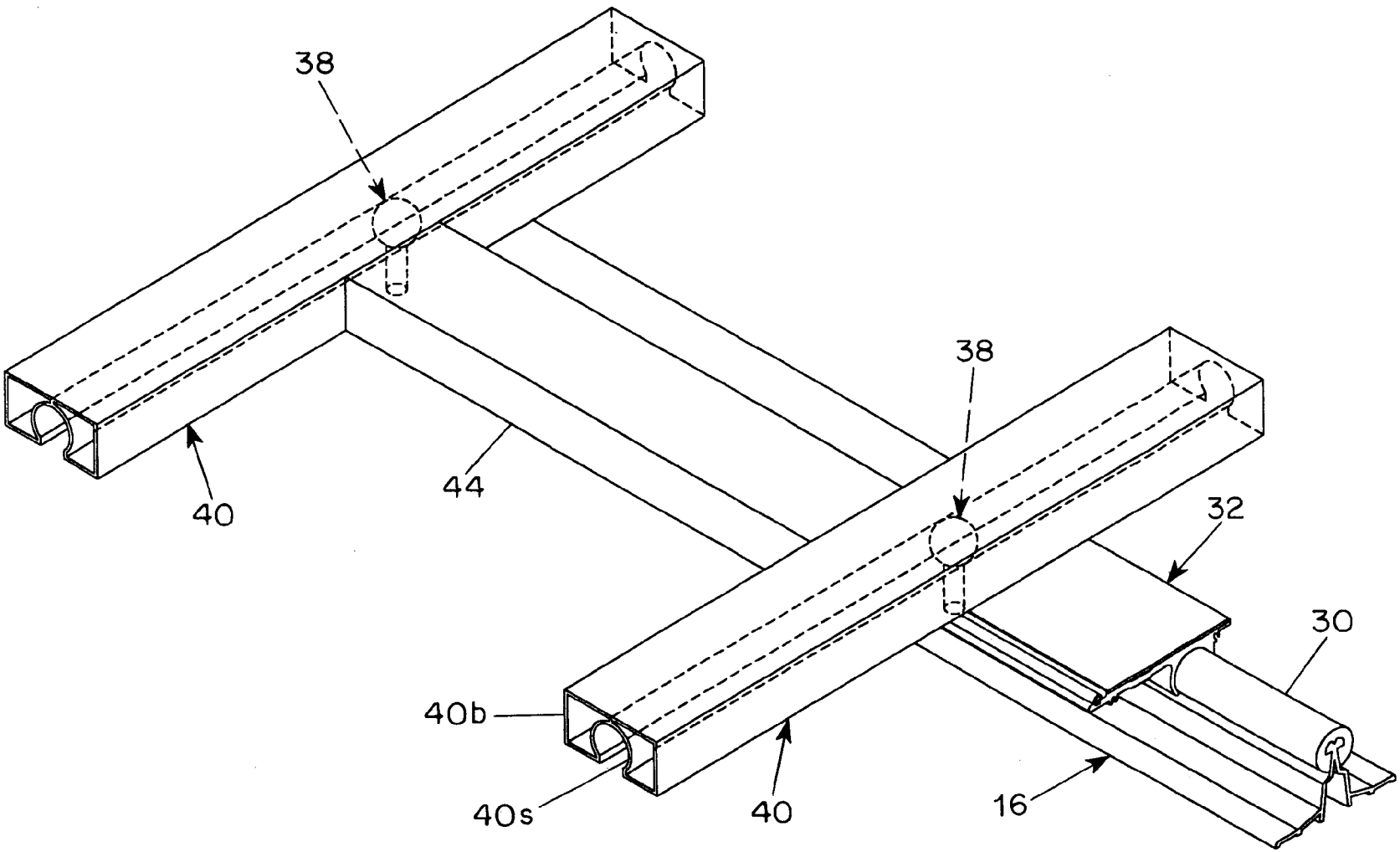
FIG. 3 is a schematic perspective view of a portion of the embodiment.

The embodiment shown in the drawings is configured for installation between a building unit A and a building unit B, which are separated by a motion-absorbing gap G. Building unit A is taller than building unit B. Accordingly, the A side of the roof cover assembly 10 over the gap G is fastened to the wall of building A by a structural angle 12 and masonry anchor bolts 14 (FIG. 2). The A side of a cover assembly for building units of the same height may be fastened to a parapet or any other structure of the roof of building unit A.

An elongated y-axis slideway 16 is affixed by screws 18 to a box beam 20 on the top of a parapet P on the building unit B. The slideway 16 extends along a y-axis that is longitudinally parallel to a center plane of the gap G (see FIGS. 2 and 4) and is an aluminum extrusion that includes in cross section a base portion 22 and an upright leg portion 24. Grooves accept alignment pins 26 at each end splice between sections of the slideway. Tapered shims 28 are used where required to level the slideway. The leg portion 24 receives a continuous bearing member 30 (which may be spliced as required) of a durable, low-friction polymeric material, such as "DELRIN."

Figure 4:
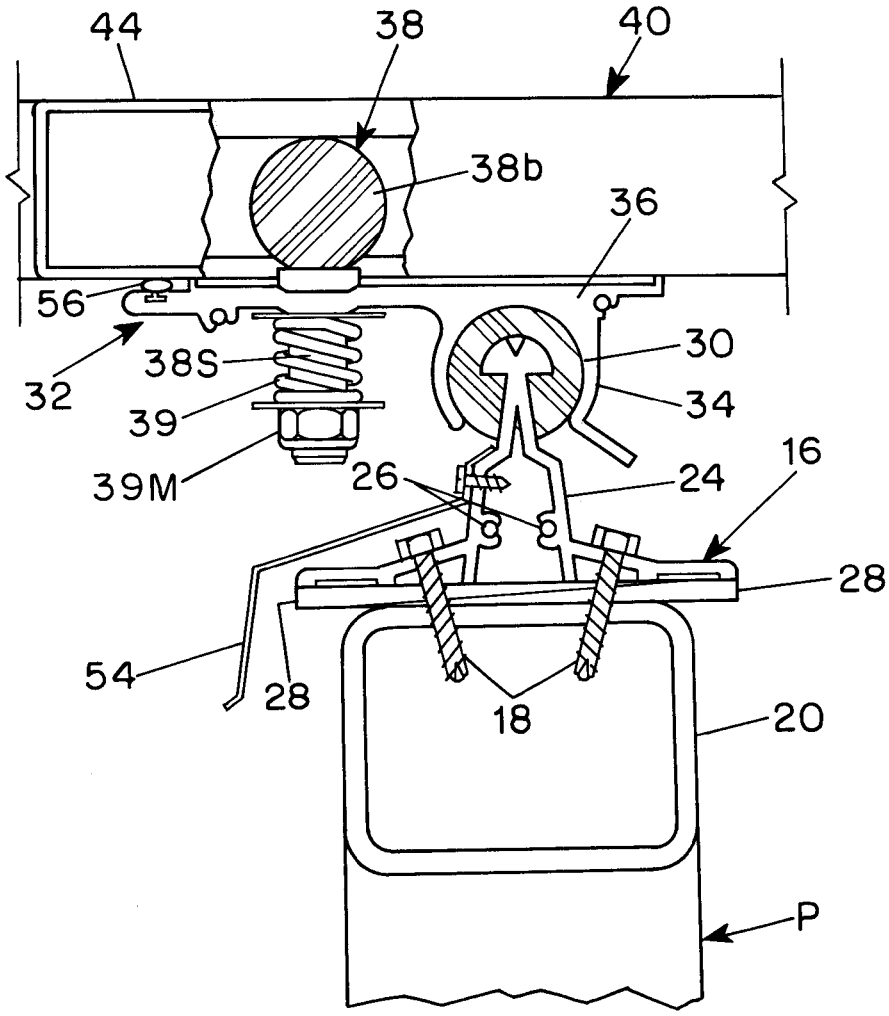
FIG. 4 is a detail end cross-sectional view of the y-axis slideway, the y-axis slider and a portion of the framework.
Figure 5:
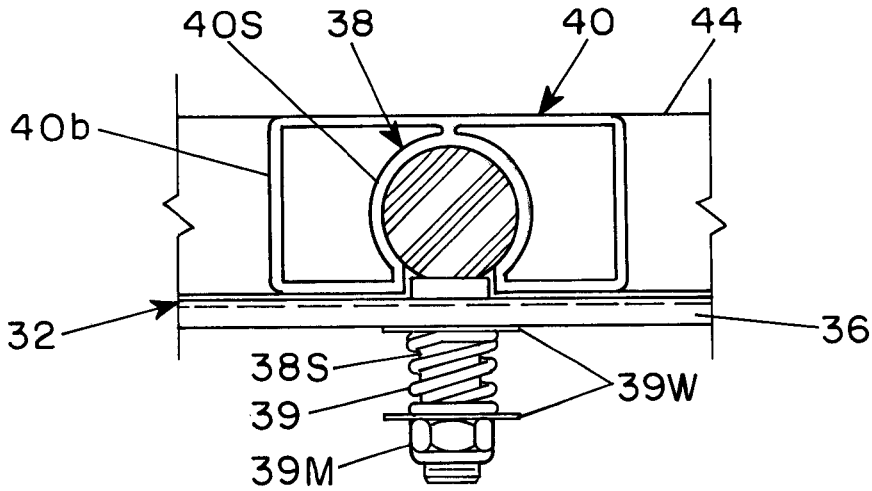
FIG. 5 is a detail cross-sectional view of a roof support member and a portion of the framework.

A y-axis slider 32 is received on the bearing member 30 of the y-axis slideway 16 for sliding movement (see FIGS. 2 and 4). The y-axis slider is an aluminum extrusion and includes in cross-section a socket portion 34 that is received on the bearing member 30 of the y-axis slideway 16 in captured relation and a supporting base portion 36. A plurality of roof support members 38 are secured to the base portion 36 of the y-axis slider in spaced apart relation against horizontal movements relative to the y-axis slider.

The B side of the roof cover assembly 10 is supported on the roof support members 38 in a manner that allows the building unit B to move in the x-axis direction (perpendicular to the gap G) relative to the roof cover assembly. The assembly 10 includes a plurality of elongated spaced-apart extruded aluminum x-axis slide members 40, each of which is supported by a support member 38. Each x-axis slide member 40 has a length such that it is supported by the roof support member throughout a range of displacements in the x-axis direction of the building units between maximum and minimum design displacements in an earthquake from a neutral position. The maximum and minimum design displacements are dependent upon the length of the motion-absorbing gap between the structural units at the expansion joints. The gap is wide enough to allow the units to move toward and away from each other. The gap must also be wide enough to prevent the units from ever making contact when they move towards each other. The seismic roof motion-absorbing gap cover of the present invention will be designed to permit total relative displacements of nearly twice those magnitudes both perpendicular to and parallel to the gap. For example, a cover for a gap of 40 inches will be designed to allow the gap to narrow to near 0 inches and to widen to nearly 80 inches. In the illustrated embodiment, the x-axis slide members 40 form parts of a base of a skeletal frame that includes cross members 42, 43 and 44 and diagonal braces 46 (FIGS. 1 and 2) between the adjacent x-axis slide members 40. The base of the frame is fabricated in modular sections (see FIG. 1) for ease of erection of the cover assembly. For light weight and weather durability, all members of the base of the framework are aluminum and are joined by welding. After the base of the skeletal frame is installed, aluminum stringers 48 of hat-shaped cross-section are fastened by welding or mechanical fasteners to the portion of the base frame above the gap G.

Each roof support member 38 includes a spherical head portion 38*b* of a durable, low-friction polymeric material, such as "DELRIN," and a shank 38*s* to which the head portion is attached by screwing the shank into a hole in the head portion (not shown). The shank 38*s* is inserted from above through a hole in the base portion 36 of the y-axis slider 32. A spring 39 loaded in compression by a nut 39*m* and flanked by washers 39*w* biases the roof support member 38 against upward displacement from the base portion of the y-axis slider 34.

Each roof support member 38 supports one of the x-axis slide members 40 by reception of the spherical head portion 38*b* in sliding relation in a socket portion 40*s*. A box-shaped body portion 40*b* covers the socket portion for protection of the socket portion from rain and dirt intrusion and imparts bending strength to the slide member 40. The spherical head portion 38*b* of each roof support member 38 presents arcuate surfaces that permit the x-axis slide member that it supports to rotate about the x-axis and about a center y-axis of the roof support member perpendicular to a plane parallel to the x-axis and y-axis, thus to accommodate slight tilting and skewing motions of the frame relative to building unit B. The springs 39 allow the roof support members 38 to lift up off the y-axis slider 36 and also rock or tilt in any direction when unit B tilts or skews relative to unit A in an earthquake.

A suitable weather cover 50 that includes panels 50*p* of sheet material and raised battens 50*b* is fastened to the stringers 48. The A end of the weather cover includes end flange portions 50*f* of the panels 50*p* that are joined by anchor bolts 50*b* to building unit A and flashing 52. The weather cover 50 extends across the motion-absorbing gap G and beyond the parapet of building unit B to provide an overhang (FIG. 2). The overhang should be made small so as to keep forces due to wind acting upwardly under the overhang at a minimum, lest the down forces of the springs 39 be exceeded. Wind-blown rain and dirt are kept from intruding into the gap G from below the overhang of the weather cover by flashing 54 fastened by screws to the y-axis slideway 16 and a compressible seal 56 inserted into a groove in the y-axis slide member 32 and sealing against the undersurfaces of the frame cross pieces 42 and the x-axis slide members 40. (FIG. 4)

In the embodiment, the y-axis slider 32 extends continuously along the y-axis slideway 16. One reason for making it continuous is so that it will serve as a weather and dirt barrier. A y-axis slide system may be composed of separate members located below each x-axis slider 40, in which case a sealing strip bridging the vertical gap between the cross pieces 42 and the y-axis slideway can be provided.

Figure 1:
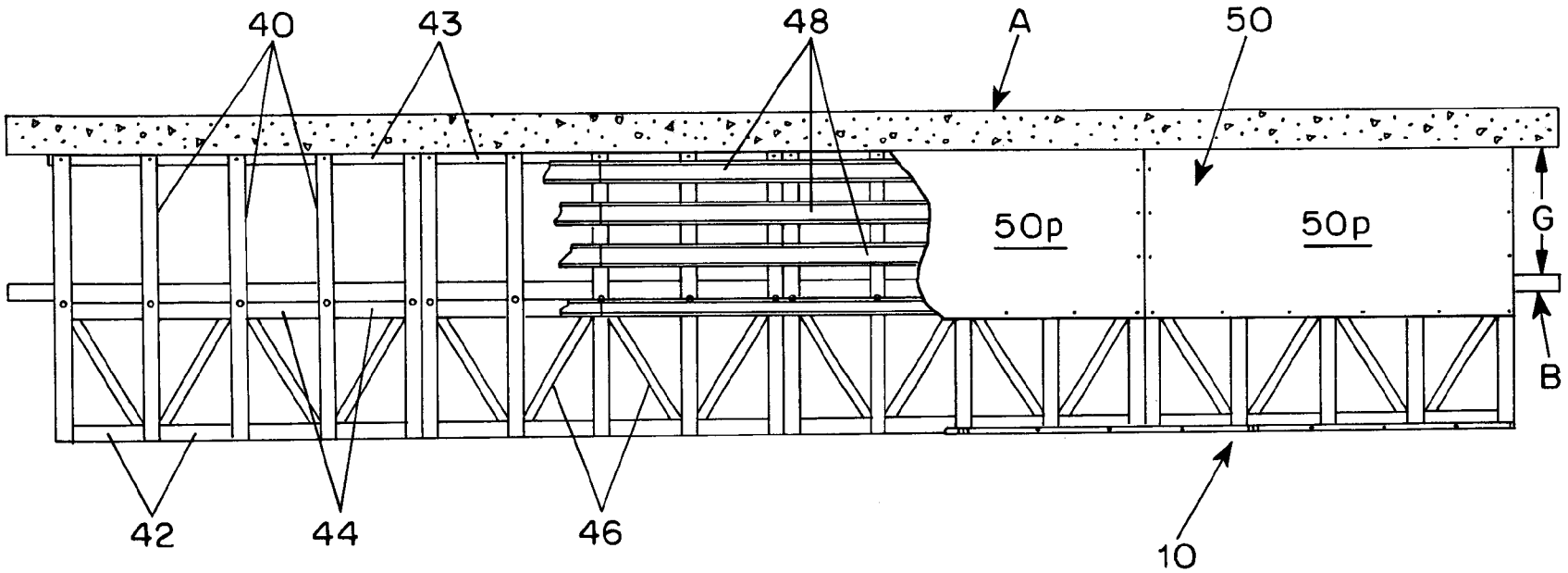
FIG. 1 is a top plan view of an embodiment of a roof motion-absorbing gap cover installation according to the present invention, portions being broken away.

FIGS. 1 and 2 show the motion-absorbing gap cover assembly in a neutral (no earthquake) position. In an earthquake, relative movements of building units A and B toward and away from each other in the x-axis direction is accommodated by sliding of the x-axis slide members 40 (and the roof structure they support) relative the roof support members 38—that can be visualized from FIG. 2 by imagining unit B moving laterally parallel to the bottom of the drawing sheet toward and away from unit A and recognizing that the roof support members 38 are horizontally fixed to the parapet P whereas the roof structure carried by the x-axis slide members 40 is fixed to unit A (see bolts 13 in FIG. 2). Relative movements of units A and B in the y-axis direction are afforded by axial sliding of the y-axis slider 32 and all components above it along the y-axis slideway 16. Visualize unit B in FIG. 2 moving perpendicular to the drawing sheet while unit A remains stationary—the y-axis slider and everything above it do not move, while unit B and the Y-axis slideway 16 move in and out relative to the plane of the drawing sheet. Needless to say, both x-axis and y-axis movements may and almost always will occur simultaneously.

Figure 6:
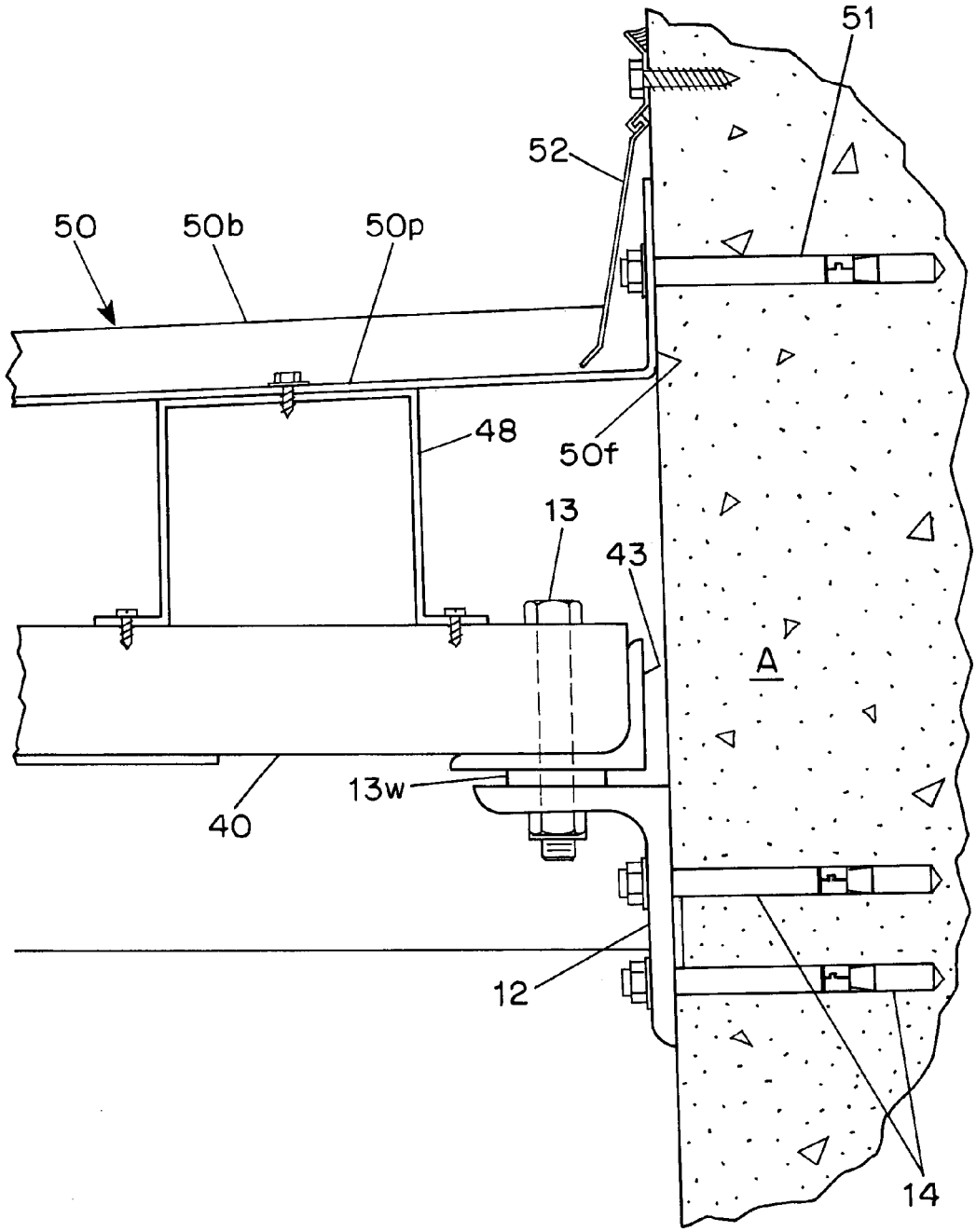
FIG. 6 is a detail side elevational view of the connection of the roof cover assembly to building unit A.

Vertical movements of unit B relative unit A involve not only slight rotation of the x-axis slide members 40 and the y-axis slider 36 about the bearing member 30 but tilting of the cover assembly relative to the structural angle 12 by which the A end of the roof cover assembly is attached to building unit A. As shown in FIG. 6, elastomeric washers 13*w*, which may be a neoprene rubber washer about ¼ inch thick, are interposed between the cross members 43 and the structural angle 12 at the locations of the bolts 13. The holes that receive the bolts 13 are made sufficiently larger than the shanks of the bolts to allow the members 43 and 40 to displace relative to the bolts 13 as the members 40 tilt up and down. The flange portions 50*f* of the panels 50*p* are flexible and allow the A end of the roof structure to tilt by bending.

The ability of the cover structure to accommodate small skewing movements of units A and B that accompany y-axis and x-axis movements is described above.

What is claimed is:

1. A seismic roof motion-absorbing gap cover assembly, comprising an elongated y-axis slideway affixed to a building unit B on one side of an motion-absorbing gap and extending along a y-axis longitudinally parallel to a center plane of the motion-absorbing gap, a y-axis slider received on the y-axis slideway for sliding movement, a plurality of roof support members secured to the y-axis slider in spaced apart relation against horizontal movements relative to the y-axis slider, and a roof having one end affixed to a building unit A on the other side of the motion-absorbing gap, spanning the motion-absorbing gap, and supported on the roof support members by a plurality of elongated spaced-apart x-axis slide members for movement relative to the roof support members along an x-axis perpendicular to the center plane of the motion-absorbing gap, each x-axis slide member having a length such that it is supported by the roof support member throughout a range of displacements in the x-axis direction of the building units between maximum and minimum design displacements in an earthquake from a neutral position, wherein each x-axis slide member is a member of a framework of the roof and is affixed to the building unit A at one end and extends continuously across the motion-absorbing gap) and beyond the roof support member by a distance not less than a maximum design displacement in an earthquake.

2. The seismic roof motion-absorbing gap cover assembly according to claim 1, wherein each x-axis slide member is of uniform cross-section along its length and includes a socket portion receiving the roof support member in captured relation and a cover portion along the top and sides of the socket portion.

3. The seismic roof motion-absorbing gap cover assembly according to claim 2, wherein each roof support member has arcuate surfaces that permit the x-axis slide member that it supports to rotate about the x-axis and about a center y-axis of the roof support member perpendicular to a plane parallel to the x-axis and y-axis.

4. The seismic roof motion-absorbing gap cover assembly according to claim 3, wherein each roof support member has a substantially spherical head portion.

5. The seismic roof motion-absorbing gap cover assembly according to claim 2, wherein each roof support member is mounted on the y-axis slider for upward displacement from and for tilting in all directions relative to a supporting surface of the y-axis slider.

6. The seismic roof motion-absorbing gap cover assembly according to claim 4, wherein each roof support member is resiliently biased against the upward displacement and tilting.

7. The seismic roof motion-absorbing gap cover assembly according to claim 2, wherein each roof support member has arcuate surfaces that permit the x-axis slide member that it supports to rotate about the x-axis and about a center y-axis of the roof support member perpendicular to a plane parallel to the x-axis and y-axis, is mounted on the y-axis slider for upward displacement from and for tilting in all directions relative to a supporting surface of the y-axis slider, and is resiliently biased against the upward displacement and tilting.

8. The seismic roof motion-absorbing gap cover assembly according to claim 1, wherein the y-axis slideway includes a base member of uniform cross section along its length having an upstanding leg portion, and a continuous bearing member of a durable, rigid, low-friction polymeric material received on the base member.

9. The seismic roof motion-absorbing gap cover assembly according to claim 8, wherein the y-axis slider has a supporting base portion on which the roof support members are mounted and a socket portion depending from the base portion and receiving the bearing member in captured relation.

10. The seismic roof motion-absorbing gap cover assembly according to claim 9, wherein the bearing member and the socket portion of the y-axis slider are arcuate in cross section so that the y-axis slider can rotate relative to the bearing member about the longitudinal center axis of the bearing member.

11. The seismic roof motion-absorbing gap cover assembly according to claim 1, wherein the roof includes a skeletal framework and a weather cover supported by the framework, the weather cover having a width in the x-axis direction greater that the width in the x-axis direction of the motion-absorbing gap but less that the width in the x-axis direction of the framework.

12. The seismic roof motion-absorbing gap cover assembly according to claim 1, wherein the roof is affixed to building unit A for tilting about a tilt axis parallel to the center plane of the motion-absorbing gap so as to accommodate vertical movements of building unit B relative to building unit A.

13. A seismic roof motion-absorbing gap cover assembly, comprising an elongated y-axis slideway affixed to a building unit B on one side of a motion-absorbing gap and extending along a y-axis longitudinally parallel to a center plane of the motion-absorbing gap, a y-axis slider received on the y-axis slideway for sliding movement, a plurality of roof support members secured to the y-axis slider in spaced apart relation against horizontal movements relative to the y-axis slider, and a roof having a skeletal structure that includes a plurality of elongated x-axis slide members, each having an A end affixed to a building unit A on the other side of the motion-absorbing gap, an intermediate portion supported on one of the roof support members for movement relative to the y-axis slider along an x-axis perpendicular to the center plane of the motion-absorbing gap, and a B end spaced apart from the y-axis slider by a distance not less than a maximum design displacement from a neutral spacing of building units A and B away from each other in an earthquake, wherein each x-axis slide member is a member of a framework of the roof and is affixed to the building unit A at one end and extends continuously across the motion-absorbing gap and beyond the roof support member by a distance not less than a maximum design displacement in an earthquake.

14. The seismic roof motion-absorbing gap cover assembly according to claim 13, wherein each x-axis slide member is of uniform cross-section along its length and includes a socket portion receiving the roof support member in captured relation and a cover portion along the top and sides of the socket portion.

15. The seismic roof motion-absorbing gap cover assembly according to claim 13, wherein each roof support member has a substantially spherical head portion.

16. The seismic roof motion-absorbing gap cover assembly according to claim 13, wherein each roof support member is mounted on the y-axis slider for upward displacement from and for tilting in all directions relative to a supporting surface of the y-axis slider.

17. The seismic roof motion-absorbing gap cover assembly according to claim 16, wherein each roof support member is resiliently biased against the upward displacement and tilting.

18. The seismic roof motion-absorbing gap cover assembly according to claim 13, wherein each roof support member has arcuate surfaces that permit the x-axis slide member that it supports to rotate about the x-axis and about a center y-axis of the roof support member perpendicular to a plane parallel to the x-axis and y-axis, is mounted on the y-axis slider for upward displacement from and for tilting in all directions relative to a supporting surface of the y-axis slider, and is resiliently biased against the upward displacement and tilting.

19. The seismic roof motion-absorbing gap cover assembly according to claim 13, wherein the y-axis slideway includes a base member of uniform cross section along its length having an upstanding leg portion, and a continuous bearing member of a durable, rigid, low-friction polymeric material received on the base member.

20. The seismic roof motion-absorbing gap cover assembly according to claim 19, wherein the y-axis slider has a supporting base portion on which the roof support members are mounted and a socket portion depending from the base portion and receiving the bearing member in captured relation.

21. The seismic roof motion-absorbing gap cover assembly according to claim 20, wherein the bearing member and the socket portion of the y-axis slider are arcuate in cross section so that the y-axis slider can rotate relative to the bearing member about the longitudinal center axis of the bearing member.

22. The seismic roof motion-absorbing gap cover assembly according to claim 13, wherein the roof includes a skeletal framework and a weather cover supported by the framework, the weather cover having a width in the x-axis direction greater that the width in the x-axis direction of the motion-absorbing gap but less that the width in the x-axis direction of the framework.

23. The seismic roof motion-absorbing gap cover assembly according to claim 13, wherein the roof is affixed to building unit A for tilting about a tilt axis parallel to the center plane of the motion-absorbing gap so as to accommodate vertical movements of building unit B relative to building unit A.

* * * * *

UNITED STATES PATENT AND TRADEMARK OFFICE

CERTIFICATE OF CORRECTION

PATENT NO. : 6,675,539 B2
APPLICATION NO. : 09/883517
DATED : January 13, 2004
INVENTOR(S) : Shreiner, Thomas A.

It is certified that error appears in the above-identified patent and that said Letters Patent is hereby corrected as shown below:

Column 3,
line 47, "1." should be deleted.

Column 6,
line 41, "an" should read -- a --
line 47, "spaced apart" should read -- spaced-apart --
line 65, "gap)" should read -- gap --

Column 7,
line 3, "cross-section" should read -- cross section --

Column 8,
line 30, "cross-section" should read -- cross section --

Signed and Sealed this

Fifteenth Day of August, 2006

JON W. DUDAS
*Director of the United States Patent and Trademark Office*